US011209219B1

(12) United States Patent
Youchison

(10) Patent No.: US 11,209,219 B1
(45) Date of Patent: Dec. 28, 2021

(54) CIRCUMFERENTIAL FLOW FOAM HEAT EXCHANGER

(71) Applicant: Sandia Corporation, Albuquerque, NM (US)

(72) Inventor: Dennis L. Youchison, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 1388 days.

(21) Appl. No.: 14/024,101

(22) Filed: Sep. 11, 2013

(51) Int. Cl.
*F28F 1/10* (2006.01)

(52) U.S. Cl.
CPC ..... *F28F 1/10* (2013.01)

(58) Field of Classification Search
CPC ..... F28D 7/10; F28D 7/16; F28D 1/05308; F28D 1/05316; F28D 1/0535; F28D 1/05375; F28D 7/1607; F28D 7/1615; F28D 7/163; F28D 7/71661; F28F 3/12; F28F 9/22; F28F 1/42; F28F 1/00; F28F 1/10; F28F 3/14; F28F 13/00; F28F 13/003; F28F 13/06; F28F 13/08; F28F 13/18
USPC ... 165/154, 86, 90, 169, 141, 155, 170, 907, 165/915
See application file for complete search history.

(56) References Cited

U.S. PATENT DOCUMENTS 3,235,003 A * 2/1966 Smith ..... F01N 1/125 165/135
3,323,586 A * 6/1967 Burne ..... F28D 7/106 165/154
3,339,260 A * 9/1967 Burne ..... F28D 7/106 29/890.036
3,364,951 A * 1/1968 Burne ..... B21D 53/06 138/38
4,018,264 A * 4/1977 Albertson ..... F28F 13/187 165/133
4,096,616 A * 6/1978 Coffinberry ..... B21D 53/06 29/890.036
4,372,374 A * 2/1983 Lee ..... F28D 7/103 165/154
4,923,003 A * 5/1990 Stenlund ..... F28F 1/42 165/154
4,964,459 A * 10/1990 Stenlund ..... F28D 7/106 123/41.33
5,072,784 A * 12/1991 Stenlund ..... F16H 57/0415 165/164
5,323,849 A * 6/1994 Korczynski, Jr. ..... F28D 7/16 165/158
6,019,168 A * 2/2000 Kinnersly ..... F28D 7/106 165/154
6,561,265 B2 * 5/2003 Ohira ..... F28D 7/0066 165/11.1
7,191,824 B2 * 3/2007 Wu ..... F02B 29/0462 165/141
7,331,381 B2 * 2/2008 Wang ..... F28D 7/10 165/166

(Continued)

*Primary Examiner* — Len Tran
*Assistant Examiner* — Gustavo A Hincapie Serna
(74) *Attorney, Agent, or Firm* — Daniel J. Jenkins

(57) ABSTRACT

A heat exchanger is disclosed that includes a cold heat exchange zone including a foam material having an annular geometry and having fluid distribution and collection slots configured to distribute a cooling fluid circumferentially through the foam material.

5 Claims, 10 Drawing Sheets

(56) References Cited

U.S. PATENT DOCUMENTS

| | | | | |
|---|---|---|---|---|
| 7,377,419 | B1 * | 5/2008 | Howard | B23K 1/0012 228/221 |
| 2006/0096750 | A1 * | 5/2006 | Meuzelaar | F28F 13/003 165/181 |
| 2010/0038051 | A1 * | 2/2010 | Behrens | B64C 1/40 165/41 |
| 2012/0199331 | A1 * | 8/2012 | Maurer | F28D 7/024 165/172 |
| 2012/0199334 | A1 * | 8/2012 | Maurer | F28F 13/003 165/185 |

* cited by examiner

2X @ 90 DEGREES SECTIONAL VIEW A-A

2X @ 90 DEGREES SECTIONAL VIEW A-A
ROTATED 45 DEGREES

CIRCUMFERENTIAL FLOW FOAM HEAT EXCHANGER

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

This invention relates generally to heat exchange, and more particularly to a circumferential flow, high temperature foam heat exchanger.

BACKGROUND OF THE INVENTION

Heat exchangers are widely known and used to transfer heat from one fluid to another fluid for a desired purpose. One conventional heat exchanger is a tube and fin type that generally includes fluid transfer tubes and heat conducting fins between the tubes. A fluid flows through the tubes and another fluid flows over the fins. Heat from the higher temperature one of the fluids is transferred through the tubes and fins to the other, lower temperature fluid to cool the higher temperature fluid and heat the lower temperature fluid. In many cases, the tubes are secured together by weld joints which, by their very nature, are subject to leakage.

It will be appreciated that regardless of the particular heat exchanger or regenerator configuration being used, if the cold and hot fluid streams are at different pressures, leakage may occur between the cold and hot sides. Additionally, the amount of heat transfer surface area is mostly limited by the amount of fin surface area available.

Therefore, it would be desirable to provide a heat exchanger that minimizes the leakage and maximize the amount of heat transfer surface area at a high thermal efficiency and low pressure drop.

Thus, there is a need for a heat exchanger that is easily fabricated, reduces the risk of leakage operates at high temperature with low pressure drop and improves heat transfer.

SUMMARY OF THE INVENTION

The present invention overcomes these difficulties encountered with prior art high temperature heat exchange and regeneration.

The present invention overcomes the limitations of the prior art by providing for a heat exchanger including a cold heat exchange zone including a foam material having an annular geometry and having collection and distribution slots configured to distribute a cooling fluid circumferentially through the foam material.

An object of the present invention is to improve heat transfer between hot/cold fluids.

Another object of the present invention is that the heat exchanger design confines the hottest fluid stream inside the cold stream and reduces the radiation losses to the outside environment.

An advantage of the present invention is it may be easily constructed of all very high melting point materials.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instruments and combinations particularly pointed out in the appended claims.

BRIEF DESCRIPTION OF THE DRAWINGS

The invention has other advantages and features which will be more readily apparent from the following detailed description of the invention and the appended claims, when taken in conjunction with the accompanying drawings, in which:

Figure 1:
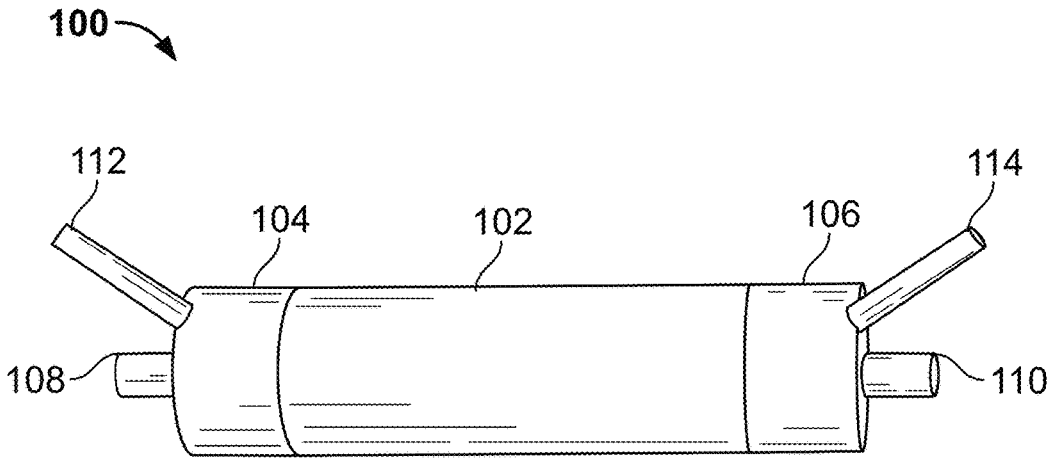
FIG. 1 is a perspective view of a heat exchanger according to an embodiment of the invention.

The figures depict embodiments of the present invention for purposes of illustration only, and are not necessarily drawn to scale. One skilled in the art will readily recognize from the following discussion that alternative embodiments of the structures and methods illustrated herein may be employed without departing from the principles of the invention described herein.

DETAILED DESCRIPTION

The present disclosure is directed to a heat exchanger having circumferential flow in the cold region. The heat exchanger includes hot and cold flow regions. The hot flow region is provided with a hot fluid that exchanges heat (transfers heat to) a cold fluid that has been provided to the cold flow region. In an embodiment, the heat exchanger may be present in a flow cycle of a power generation system. For example, the heat exchanger may be part of flow cycle of a Brayton Cycle power generation system as a heat exchanger, regenerator and/or recuperator.

The hot fluid may be a liquid or a gas. In an embodiment, the hot fluid may be a liquid metal, liquid, or pressurized gas. In an embodiment, the hot fluid may be a liquid metal such as, but not limited to liquid sodium, sodium-potassium, tin, cesium, and gallium. In another embodiment, the hot fluid may be a pressurized inert gas. In another embodiment, the hot fluid may be selected from a group including, but not limited to helium, such as hydrogen, argon, nitrogen or carbon dioxide.

The cold fluid may be a liquid or a gas. In an embodiment, the cold fluid may be an inert gas. In an embodiment, the cold fluid may be selected from a group including, but not limited to helium.

In an embodiment, the heat exchanger is used as a liquid metal-to-gas device for use as heat exchangers in liquid metal cooled reactors coupled to a Brayton cycle for power generation or used as high-temperature process heat in hydrogen production or in nuclear propulsion systems. According to the present disclosure, the manifolding and internal ducting are designed to produce low pressure drop in the device.

In an embodiment, a hot gas flow is directed azimuthally through a coaxial foam arrangement to limit the flow path length and pressure drop. In this embodiment, the hot and cold fluids are gasses, the hot leg is in a center foam core with the cold leg and pressure boundary on the outer coaxial foam. The hot leg foam is separated from the cold leg foam through a thin (<1 mm thick) wall. The foam cores may be bonded to the wall by high temperature braze to provide for maximum conduction from the hot leg foam ligaments to the cold leg foam ligaments. This geometry keeps the hot leg away from the outer shell allowing the outer shell to operate at reduced temperatures while.

In another embodiment, the hot fluid is a liquid metal and the cold fluid is a gas, and the center foam is replaced with an axial tube with dendrites deposited on the internal surface. The dendrites allow the tube to be wetted by liquid metals such as lithium at lower temperatures than typically required and promote conduction into the liquid metal while disrupting the thermal boundary layer at the wall. Computational fluid dynamics were used to optimize ligament size and foam porosity for best thermal performance, as well as develop ducting for best heat transfer and lowest pressure drop performance. In an embodiment, the heat exchanger may be scaled to dimensions for 1 kW to 10 kW applications. The units can be scaled or bundled in parallel flow arrangements to handle higher heat rejection requirements.

In an embodiment, high temperature refractory heat exchangers are disclosed that include all molybdenum (Mo), titanium-zirconium-molybdenum (TZM) or tungsten (W) pressure boundary (shell) and a two-part Mo or W foam optimized for heat transfer. Devices can be used for gas-to-gas or liquid metal-to-gas service and operate at pressures to 4 MPa and temperatures to 1000° C. The gas devices can be used as recuperators and regenerators in Brayton cycle power conversion systems.

In an embodiment, gas-to-gas and liquid metal-to-gas refractory heat exchangers are disclosed for use in high efficiency Brayton cycle power conversion for nuclear power, hydrogen production and propulsion applications. These heat exchangers operate between 600° C. and 1000° C. at high or low pressure and make use of porous refractory foam technology in the gas ducts to dramatically enhance the surface area for convective heat transfer and promote turbulence to disrupt the thermal boundary layer. These devices can function as heat exchangers, recuperators, regenerators or economizers in power conversion systems and are not presently commercially available. The design was optimized using state-of-the-art computational fluid dynamics techniques developed at Sandia and several prototype were fabricated and tested.

Figure 2:
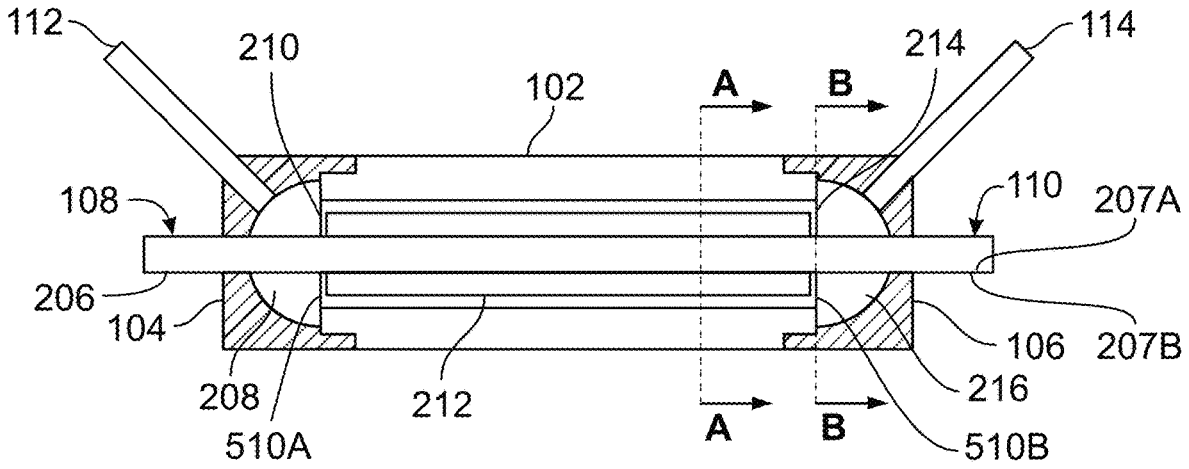
FIG. 2 is a cross sectional view of the heat exchanger of FIG. 1.

FIGS. 1-2 illustrate an embodiment of a heat exchanger 100 according to the present disclosure. As can be seen in FIG. 1, the heat exchanger 100 includes an outer shell 102, a first end cap 104, a second end cap 106, a hot fluid inlet 108, a hot fluid outlet 110, a cold fluid inlet 112 and a cold fluid outlet 114. The heat exchanger components 102-114 may be formed of a metal, ceramic, or cermet material. In an embodiment, the heat exchanger components 102-114 may be made of a high temperature metal, such as, but not limited to niobium, vanadium, Inconel, tantalum, titanium, molybdenum, TZM, Hastelloy, Haynes alloys, tungsten and alloys thereof. In another embodiment, one or more of the heat exchanger components 102-114 may be made of SiC or HfC.

Referring to FIG. 2, the heat exchanger 100 further includes a hot transfer region 202 and a cold transfer region 204. In this exemplary embodiment, the hot transfer region 202 includes an annular tube 206 through which the hot fluid flows and to which the hot fluid transfers heat, and the annular tube 206 is integral to the hot fluid inlet 108 and the hot fluid outlet 110. In another embodiment, the hot fluid inlet and outlet 108, 110 may be otherwise coupled or in fluid connectivity with the annular tube 206.

The annular tube 206 is formed of a high temperature material, such as, but not limited to niobium, vanadium, Inconel, tantalum, titanium, molybdenum, TZM, Hastelloy, Haynes alloys, tungsten and alloys thereof. SiC and HfC are ceramic alternatives. The annular tube 206 includes an inner surface 207A and an outer surface 207B. In an embodiment, the inner surface 207A may have tungsten or rhenium dendrites formed thereupon. The dendrites allow the annular tube 206 to be wetted by a liquid. In an embodiment the dendrites allow for the annular tube 206 to be wetted by a liquid metal such as lithium at lower temperatures than typically required and promote conduction into the liquid metal while disrupting the thermal boundary layer at the wall. In an embodiment, the dendrites are deposited or grown by a chemical vapor deposition process.

The cold transfer region 204 includes a manifold distribution zone 208, a first manifold 210, a heat transfer foam 212, a second manifold 214, and a manifold collection zone 216. The manifold distribution zone 208 receives a cold fluid from the cold fluid inlet 112. Cold fluid from the manifold distribution zone 208 is distributed to distribution grooves or slots 310 (FIG. 3) in the outer shell 102.

Figure 3A:
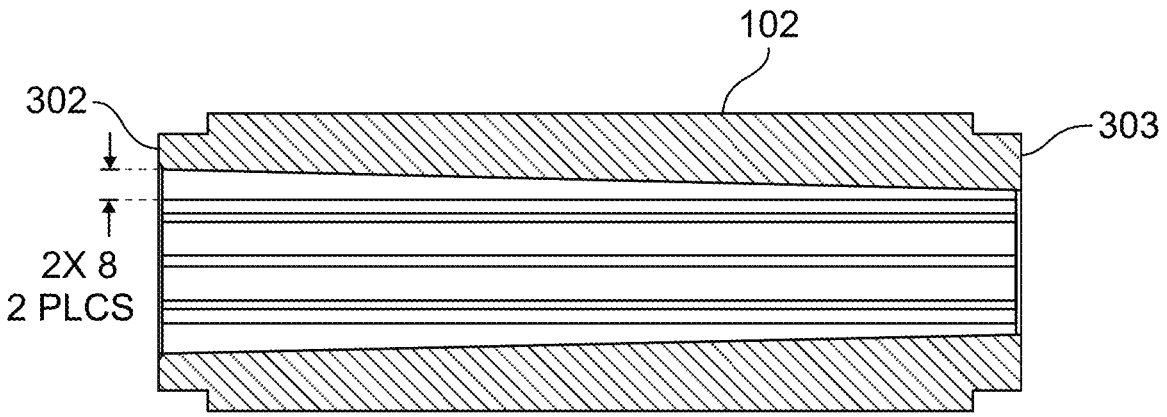
FIG. 3A is a sectional view A-A of FIG. 3C.
Figure 3B:
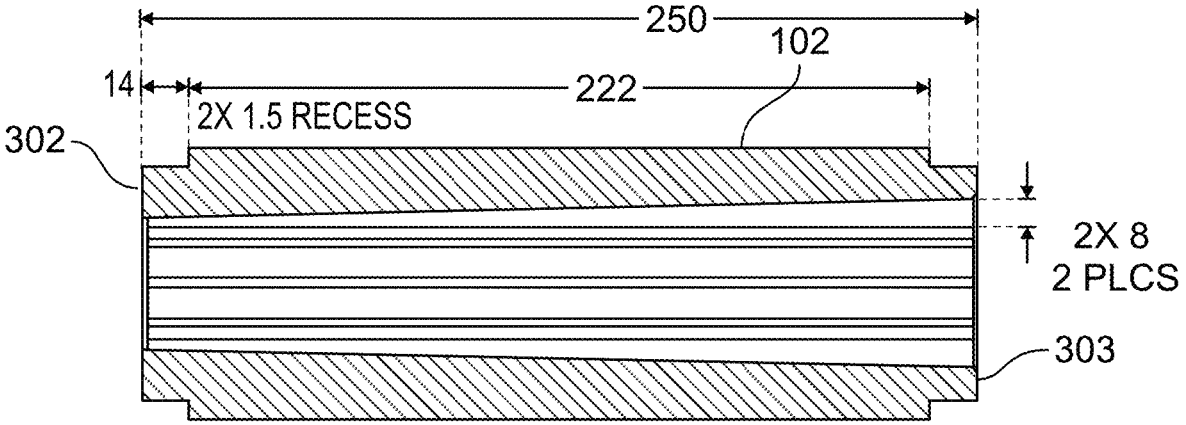
FIG. 3B is a sectional view B-B of FIG. 3C.
Figure 3C:
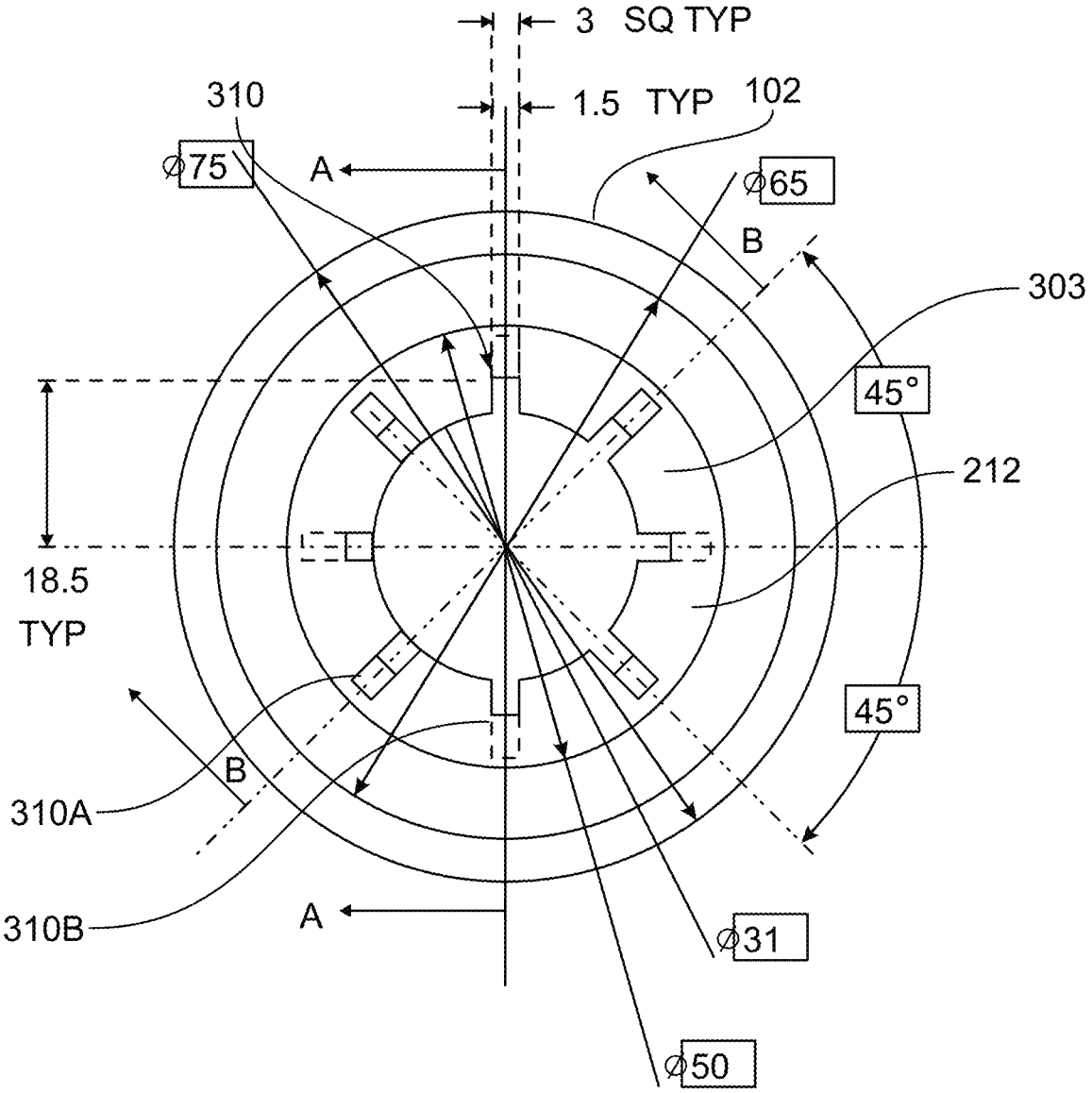
FIG. 3C is a cross sectional view of FIG. 1 taken across the diameter at line B-B.
Figure 3D:
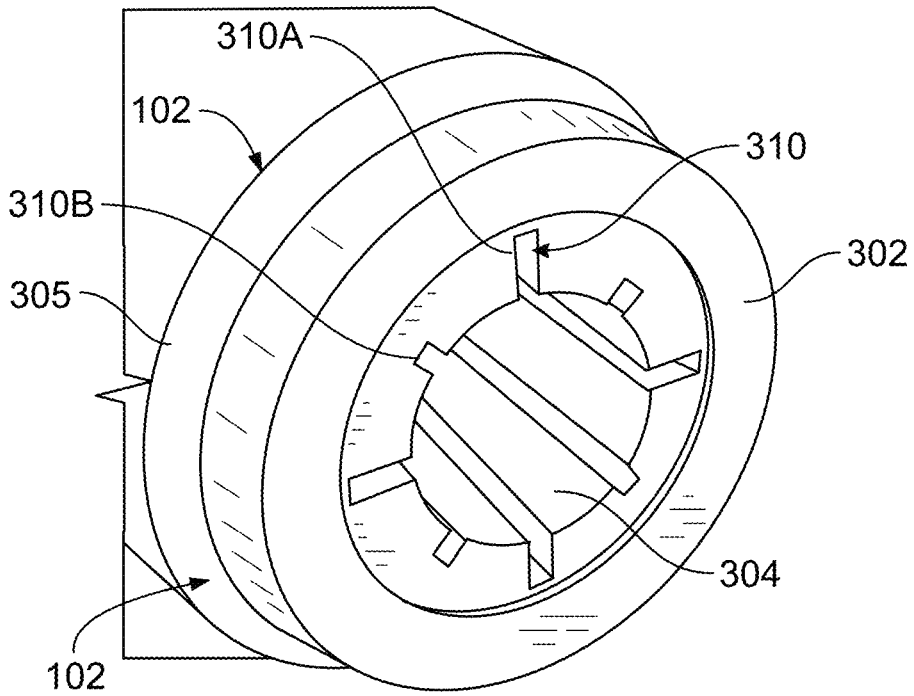
FIG. 3D is a partial perspective end view of FIG. 1 with the first end cap, first end plate and annular tube removed.

FIG. 3A shows the cross section of the outer shell 102 of FIG. 2 in greater detail. FIG. 3B shows the cross section of the outer shell 102 rotated 45 degrees around the center axis in greater detail. FIG. 3C shows a first end view of FIG. 3A, showing the rotation of FIG. 3A by 45 degrees to arrive at FIG. 3B. FIG. 3D shows an end partial perspective view of the outer shell 102 taken towards first end surface 302.

As can be seen in FIGS. 3A-C, the outer shell 102 includes an inner surface 304 and an outer surface 305. The inner surface 304 includes distribution slots 310A and recovery or collection slots 310B recessed into the inner surface 304 of the outer shell 102. The distribution and recovery slots 310A, 310B run axially from first end surface 302 to second end surface 303. In another embodiment, the distribution and collection slots 310A, 310B may not extend for the entire axial length of outer shell 102. In this exemplary embodiment, the outer shell 102 has four distribution slots 310A and four collection slots 310B. In another embodiment, the outer shell 102 may have two or more distribution slots and two or more collection slots configured to effectuate circumferential flow in the heat transfer foam 212.

In this exemplary embodiment, the slots are between 2 mm to 14 mm in depth. The width and angle of taper is chosen based on the length of the heat transfer foam 212. The slot depth and amount of taper is chosen to produce a uniform circumferential flow distribution along the length of the heat transfer foam. In another embodiment, slot width may also be tapered to control circumferential flow.

In this exemplary embodiment, the outer shell 102 is forming of a single piece of material that is cast or machined to form the slots. In another embodiment, the outer shell 102 may be formed of two or more components. For example, in another embodiment, the outer shell may be formed of an outer sleeve and an inner sleeve having the slots formed therewithin.

Cold fluid from the manifold distribution zone 208 is provided to the distribution slots 310A which further provide cold fluid to the heat transfer foam 212. The cold fluid is collected from the heat transfer foam 212 by collection slots 3108.

The distribution slots 310A are recessed with a diminishing depth having a taper from the first end surface 302 to the second end surface 303, and the collection slots are recessed with a diminishing depth having a taper from the second end surface 303 to the first end surface 302. In other words, the distribution slots 310A are tapered from the fluid input end to the end of the slot, and the collection slots 310B are tapered from the fluid output end to the end of the slot. In this exemplary embodiment, the degree of taper is between about 2 mm and 14 mm over 250 mm. The distribution slots 310A are tapered to improve pressure distribution and provide a more uniform cold fluid flow distribution along the length of the heat exchanger circumferentially into the foam from the slots to the foam heat transfer region 212. The collection slots are tapered in a complementary manner for the same purpose. In another embodiment, the distribution slots 310A and/or the collection slots 310B may be level or have no change in depth and include no taper; however, the width of the slots may be tapered to obtain the same result.

Figure 4:
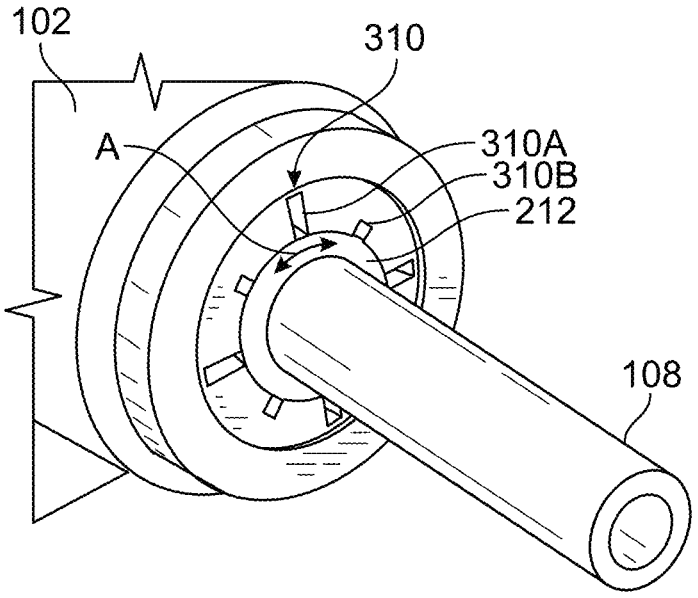
FIG. 4 is a partial perspective end view of FIG. 1 with the first end cap and first end plate removed.

FIG. 4 shows the cold fluid inlet end of the outer shell 102 surrounding the heat transfer foam 212, showing the fluid receiving end of the distribution slots 310A and the terminal end of the collection slots 310B. The opposite end (not shown) of the outer shell 102 has a similar arrangement (rotated 45 degrees) of terminal ends of the distribution slots 310 and fluid outlet ends of the distribution slots 310B. As can be seen in FIG. 4, fluid is distributed in a radial, uniform circumferential flow distribution through the transfer foam 212 as shown by arrow A.

Figure 5:
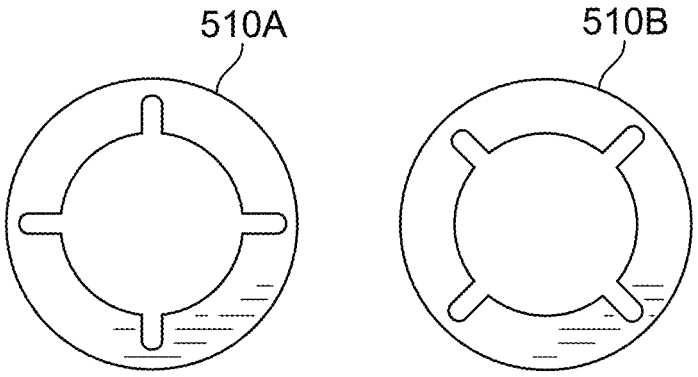
FIG. 5 are end views of the first and second end plates.

FIGS. 5A and B show the first end plate 510A and second end plate 510B, which are placed against the first and second ends 302, 303, respectively, of the outer shell 102. As can be appreciated, the second end plate 510B has the same design as the first end plate 510A, but rotated 45 degrees.

Figure 6:
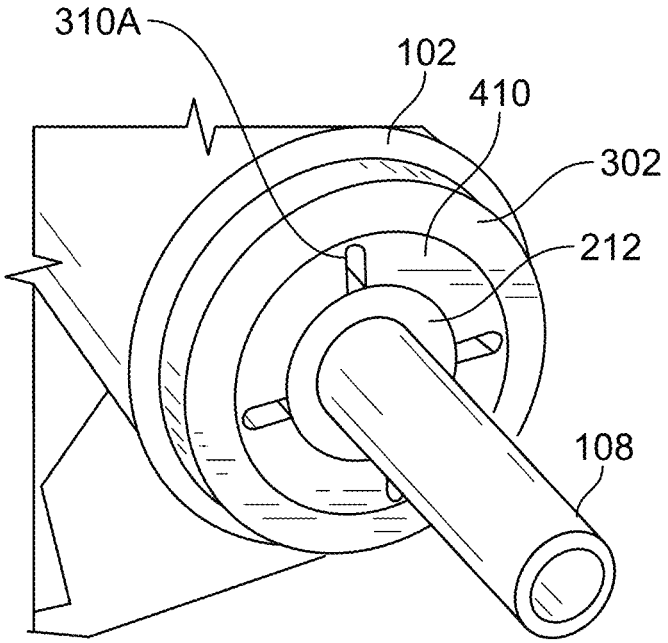
FIG. 6 is a partial perspective end view of FIG. 1 with the first end cap removed.

FIG. 6 shows the first end plate 510A arranged against the first end 302 of the outer shell 102. In such a manner, the first end plate 510A provides fluid access to distribution slots 310A while sealing the terminal ends of the collection slots 3108. The first and second end plates 510A, 510B are attached to the outer shell 102 by brazing, welding or other joining method that creates a fluid seal.

In this exemplary embodiment, the first and second end plates 510A, 510B are placed away from the hot inlet and outlet tubes 108, 110, respectively, to provide exposure to the heat transfer foam 212 to fluid in the manifold distribution zone 208 and manifold collection zone 216, respectively. In another embodiment, the first and second end plates 510A, 510B may be fit against the hot inlet and outlet tubes 108, 110, respectively. In another embodiment, the first and second end plates 510A, 510B may be fit against and fluidly sealed to the hot inlet and outlet tubes 108, 110, respectively.

According to another embodiment of the disclosure, cold fluid is provided to the heat transfer foam 212 via slots in the outer surface of the heat transfer foam. In this embodiment, the inner surface of the outer shell 102 is smooth and has no distribution or collection slots. The first and second end plates 510A, 510B are accordingly modified to provide fluid to the distribution slots and to allow for flow out from the collection slots.

Figure 7:
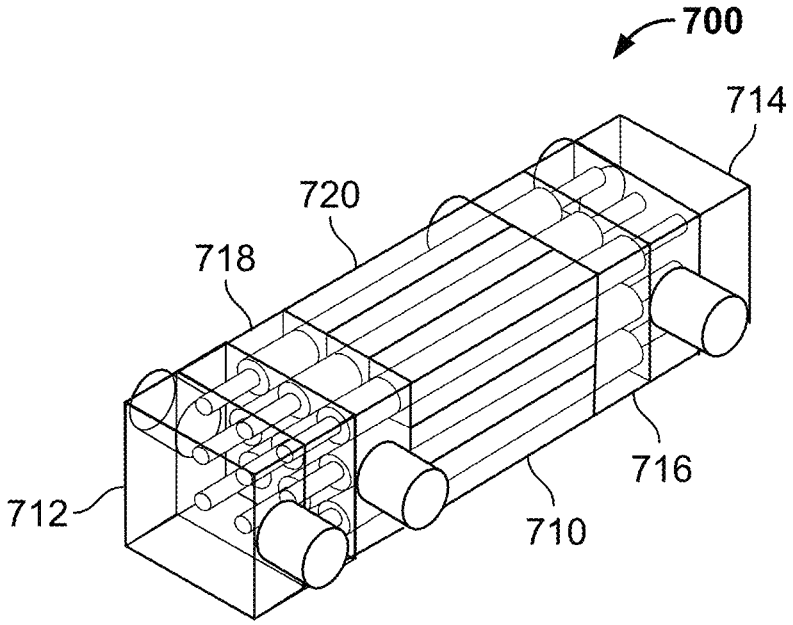
FIG. 7 is a perspective view of another heat exchanger according to an embodiment of the invention.

FIG. 7 shows another embodiment of the present disclosure wherein a heat exchanger module 700 is formed of two or more heat exchangers 710. The heat exchanger module 700 includes a cold fluid inlet end cap 712, a cold fluid outlet end cap 714, a hot fluid inlet end cap 716, and a hot fluid outlet end cap 718.

In this embodiment, the outer shells 720 of the heat exchangers have a square cross section to facilitate bundling of the heat exchangers 710. In another embodiment, the heat exchanger module 700 may include a single outer shell that has been formed with two or more through holes to accept two or more hot fluid tubes with heat exchanger foam there around. The flow distribution and collection may be as described for any of the previously described embodiments.

Figure 8:
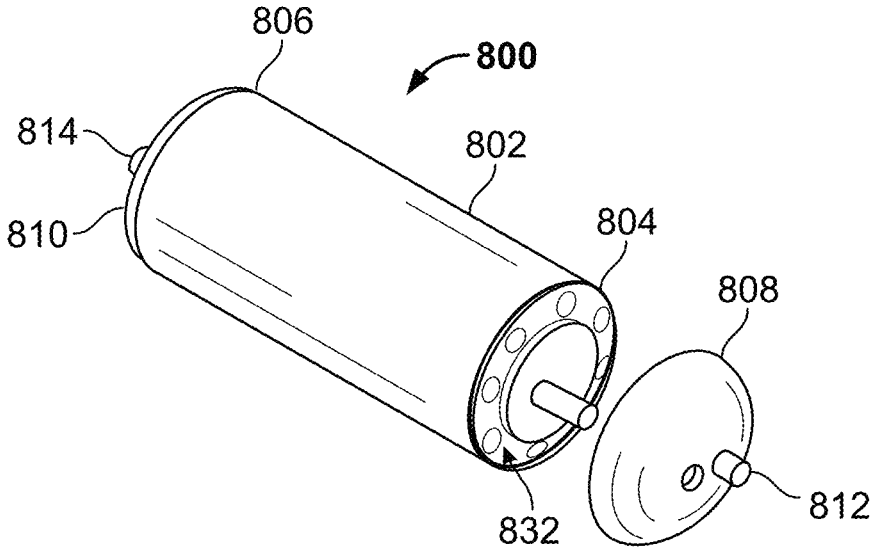
FIG. 8 is a perspective view of another heat exchanger with the end cap shown separated according to an embodiment of the invention.
Figure 9:
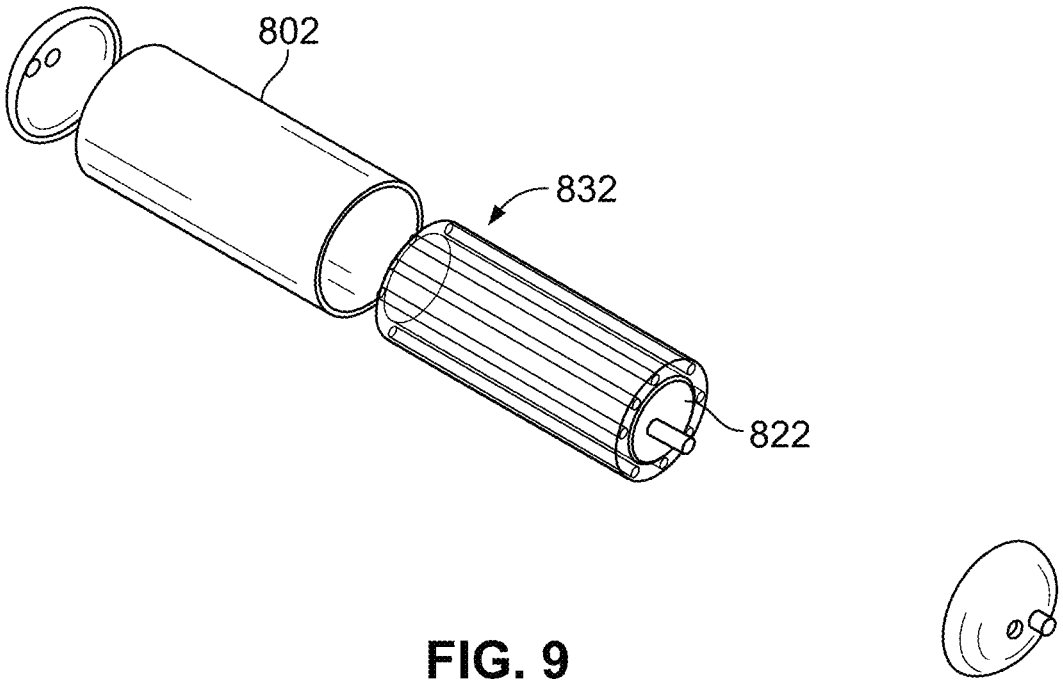
FIG. 9 is a partially exploded view of the heat exchanger of FIG. 8.
Figure 10:
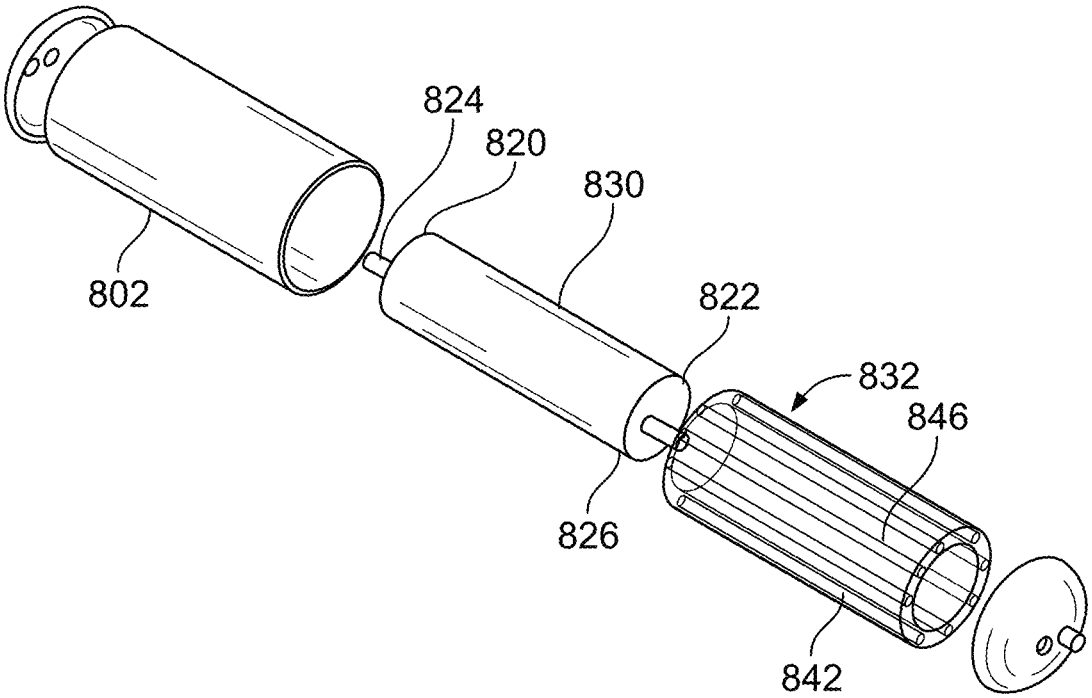
FIG. 10 is another partially exploded view of the heat exchanger of FIG. 8.
Figure 11:
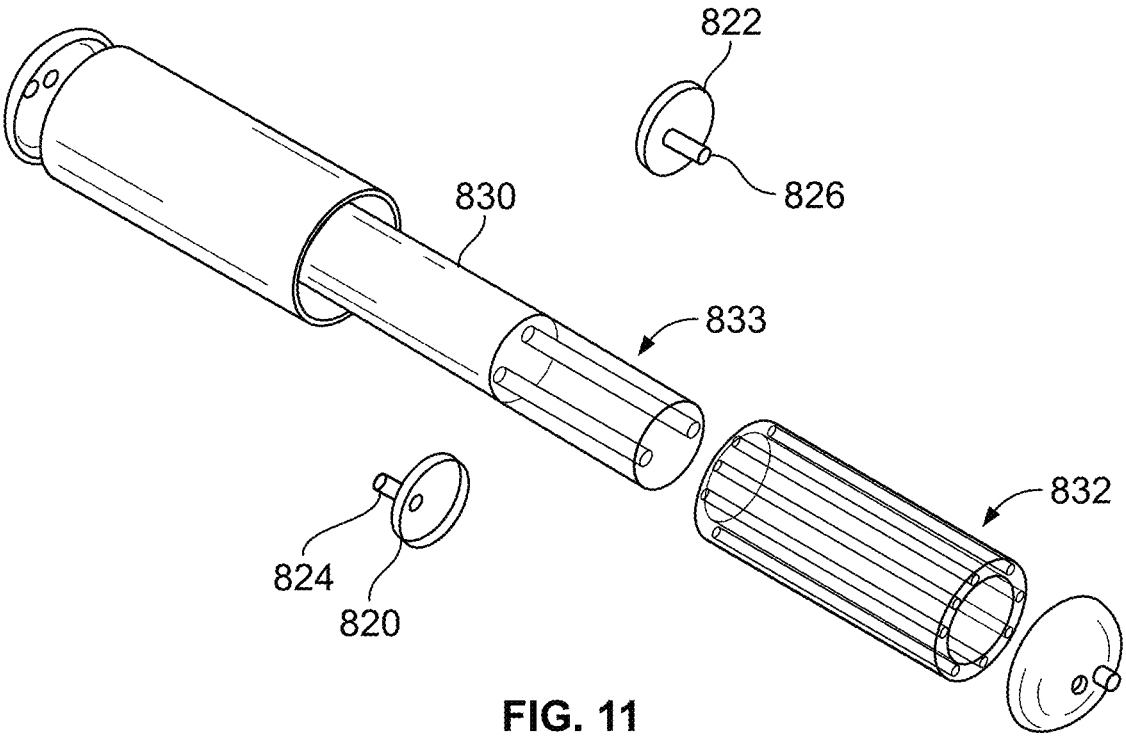
FIG. 11 is another partially exploded view of the heat exchanger of FIG. 8.
Figure 12:
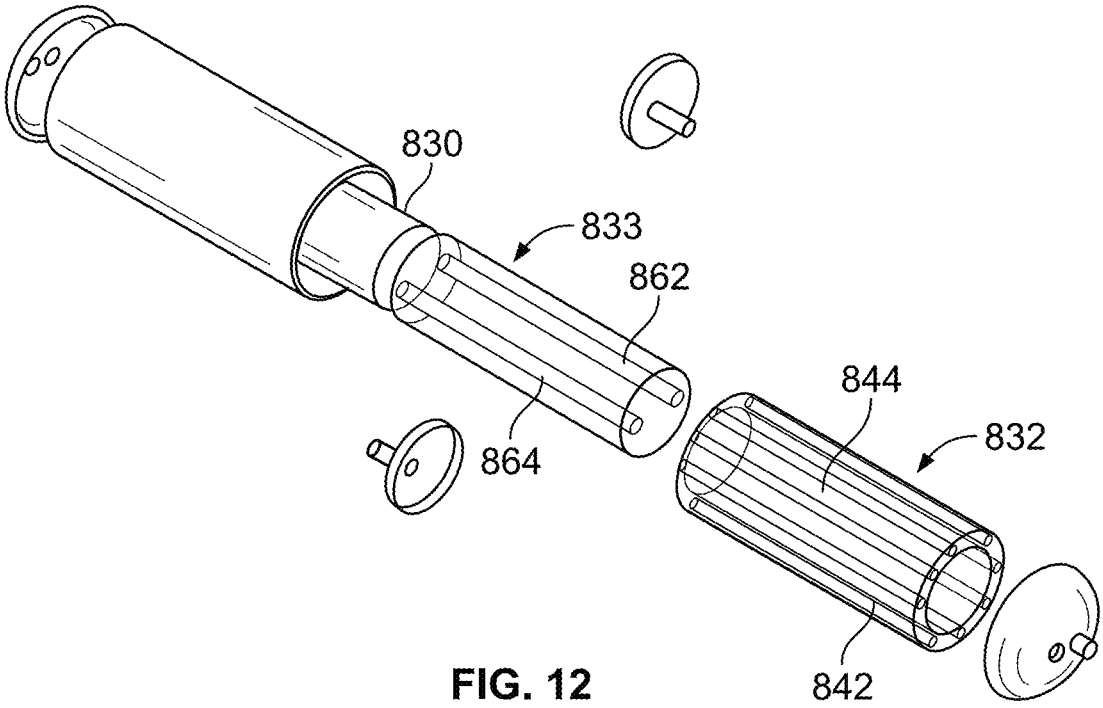
FIG. 12 is another partially exploded view of the heat exchanger of FIG. 8.
Figure 13:
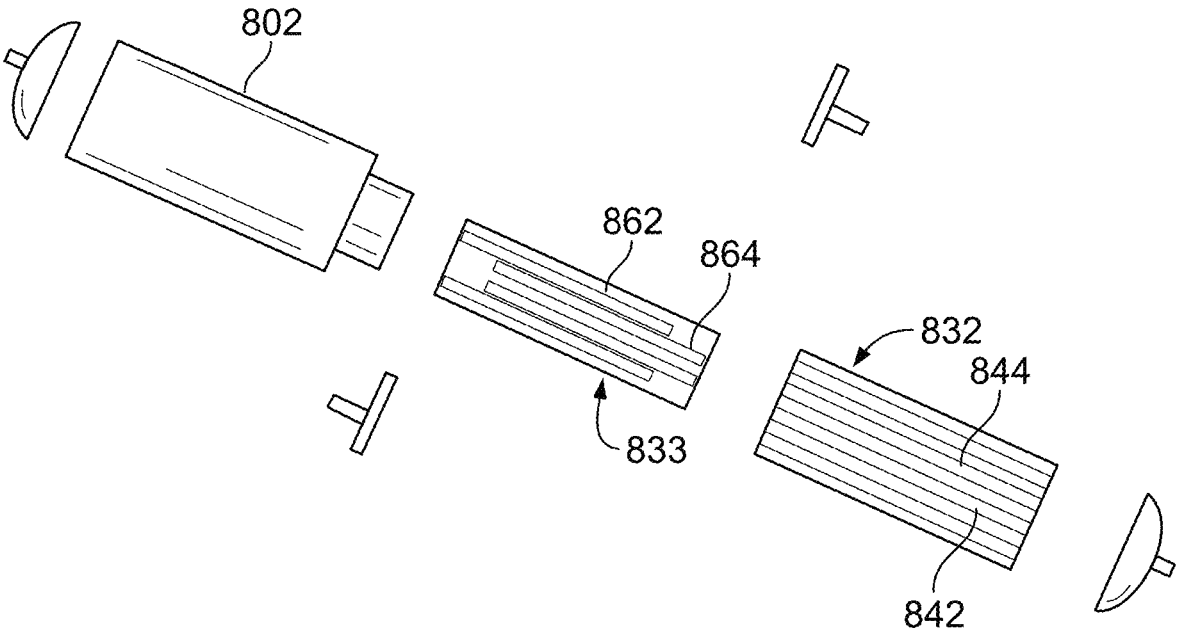
FIG. 13 is a side view of the heat exchanger of FIG. 8.

FIGS. 8-12 illustrate another embodiment of a heat exchanger 800 according to the disclosure. As can be seen in FIG. 8, the heat exchanger 800 includes an outer shell 802. The outer shell 802 includes a first end 804 and a second end 806. The heat exchanger further includes a first cold end cap 808 and a second cold end cap 810, fluidly sealed to the first and second ends 804, 806. The first and second cold end caps 804, 806 include a cold inlet 812 and a cold outlet 814, respectively.

The heat exchanger 800 further includes a first hot end cap 820 and a second hot end cap 822, each attached to an inner shell 830. The first and second hot end caps 820, 822 include a hot fluid inlet 824 and hot fluid outlet 826, respectively. The first and second hot end caps 820, 822 are attached to inner shell 830. The attachment creates a fluid seal, and may be achieved by brazing, welding, or other similar joining means. The inner shell 830 is formed of a high temperature material. The high temperature material may be a high temperature metal, such as, but not limited to such as, but not limited to, niobium, vanadium, Inconel, tantalum, titanium, molybdenum, TZM, Hastelloy, Haynes alloys, tungsten and alloys thereof. SiC and HfC are ceramic alternatives.

The inner shell 830 provides a heat transfer path and a fluid barrier between an outer heat transfer foam 832 and an inner heat transfer foam 833. The inner shell 830 is thin to improve heat transfer.

The outer and inner heat transfer foams 832, 833 are formed of a high temperature foam material. In an embodiment, the high temperature foam material may be selected from a group including, but not limited niobium, vanadium, Inconel, tantalum, titanium, molybdenum, TZM, Hastelloy, Haynes alloys, tungsten and alloys thereof. SiC and HfC are ceramic alternatives.

The outer heat transfer foam 832 has an annular shape, with an outer surface 834 and an inner surface 836. The outside diameter of the outer heat transfer foam is slightly smaller than the inside diameter of the outer shell 802. The outer heat transfer foam 832 has a contact fit with the outer shell 802. In another embodiment, the outer heat transfer foam 832 may be supported within the outer shell 802 by supports and or attachments and may or may not contact the outer shell.

The inside diameter of the outer heat transfer foam 832 is slightly larger than the outside diameter of the inner housing 830, such that a snug, contact fit is formed when the outer heat transfer foam 832 is slid over the inner housing 830. The outer heat transfer foam 832 is brazed to the inner housing 830 at the ends to improve heat transfer from the inner housing 830 to the outer heat transfer foam 834. In another embodiment, the brazing may be omitted. It is advantageous to make the entire heat exchanger out of the same material; so that all parts expand and contract at the same rate. This minimized the thermal stresses throughout the structure. The braze filler is carefully selected to match the CTE of the joined parts.

The outer heat transfer foam 832 includes cold fluid distribution channels or slots 842 and cold fluid collection channels or slots 844. The cold fluid distribution slots 842 are formed axial into the outer heat transfer foam 832 and extend axially from the inlet cold surface end to almost the outlet cold surface end. In another embodiment, the cold fluid distribution slots 842 may extend axially through the outer heat transfer foam 832, as long as the outlet end surface is sealed by a plate, braze or other material to prevent cold fluid from exiting the cold outlet end except for at the outlet of the cold fluid collection slots 844. The cold fluid distribution and collection slots 842, 844 may be formed into the outer heat transfer foam 832 by machining, drilling or other similar forming technique.

Similarly, the cold fluid collection slots 844 are formed axial into the outer heat transfer foam 832 and extend axially from the outlet cold surface end to almost the inlet cold surface end. In another embodiment, the cold fluid collection slots 842 may extend axially through the outer heat transfer foam 832, as long as the end surface is sealed by a plate, braze or other material to prevent cold fluid from exiting the cold outlet end except for at the outlet of the hot fluid collection slots 842.

In this exemplary embodiment, the cold fluid distribution and collection slots 842, 844 are formed in the internal body of the outer heat transfer foam 832. In another embodiment, the cold fluid distribution and/or collection slots 842, 844 may be formed in any combination of the inner and outer exterior radial surfaces and/or the inner annular surface of the outer shell 802.

The inner heat transfer foam 833 has a solid cylindrical shape with an outer surface 852. The outside diameter of the inner heat transfer foam 833 is in contact or snug fit with the inside diameter of the inner shell 830. The inner heat transfer foam 833 is brazed to the inner shell 830 at the ends to improve heat transfer from the inner heat transfer foam 833 to the inner shell 830. In another embodiment, the brazing may be omitted.

The inner heat transfer foam 833 includes hot fluid distribution channels or slots 862 and hot fluid collection channels or slots 864. The hot fluid distribution slots 862 are formed axial into the inner heat transfer foam 833 and extend axially from the inlet hot surface end to almost the outlet hot surface end. In another embodiment, the hot fluid distribution slots 862 may extend axially through the inner heat transfer foam 833, as long as the hot outlet end surface is sealed by a plate, braze or other material to prevent hot fluid from exiting the hot outlet end except for at the outlet of the hot fluid collection slots 864.

In this exemplary embodiment, the inner heat transfer foam 833 includes two hot fluid distribution slots 862 and two hot fluid collection slots 862. In another embodiment, the inner heat transfer foam 833 may include one or more hot fluid distribution slots and one or more hot fluid collection slots configured to provide circumferential flow through the inner heat transfer foam.

Similarly, the hot fluid collection slots 864 are formed axial into the inner heat transfer foam 833 and extend axially from the outlet hot surface end to almost the inlet hot surface end. In another embodiment, the hot fluid collection slots 864 may extend axially through the inner heat transfer foam 833, as long as the hot inlet end surface is sealed by a plate, braze or other material to prevent hot fluid from exiting the hot outlet end except for at the outlet of the hot fluid collection slots 842.

The hot fluid distribution and collection slots 862, 864 are formed into the inner heat transfer foam 833 by machining, drilling or other similar forming technique, and slotted tubes 866 are inserted into the machined slots and brazed into place to secure and improve the heat transfer from the slotted tubes 866 to the inner heat transfer foam 833. In another embodiment the inner heat transfer foam 833 may be formed around the high temperature slotted tubes, with the high temperature slotted tubes having a removable material within the inner diameter of the tubes that is later removed. In another embodiment, the slotted tubes may be omitted.

The slotted tubes 866 have open slots on the outward radial side thereof to direct and collect hot fluid into the inner heat transfer foam 833 close to the thin separation wall in a circumferential flow through the inner heat transfer foam 833. In another embodiment, the slotted tubes 866 may include one or more slots to circumferentially provide and collect hot fluid.

An advantage of this design is that the two working fluids are at nearly the same absolute pressure. Thus the separation wall can be thin; since the pressure boundary is outside the cold leg. A thin separation wall means low conduction loss through the wall; so the inner and outer foam ligaments are virtually at the same temperature. Also, having the pressure boundary surrounding the cold leg keeps it at low temperature where the pressure boundary wall material is significantly stronger.

Figure 14:
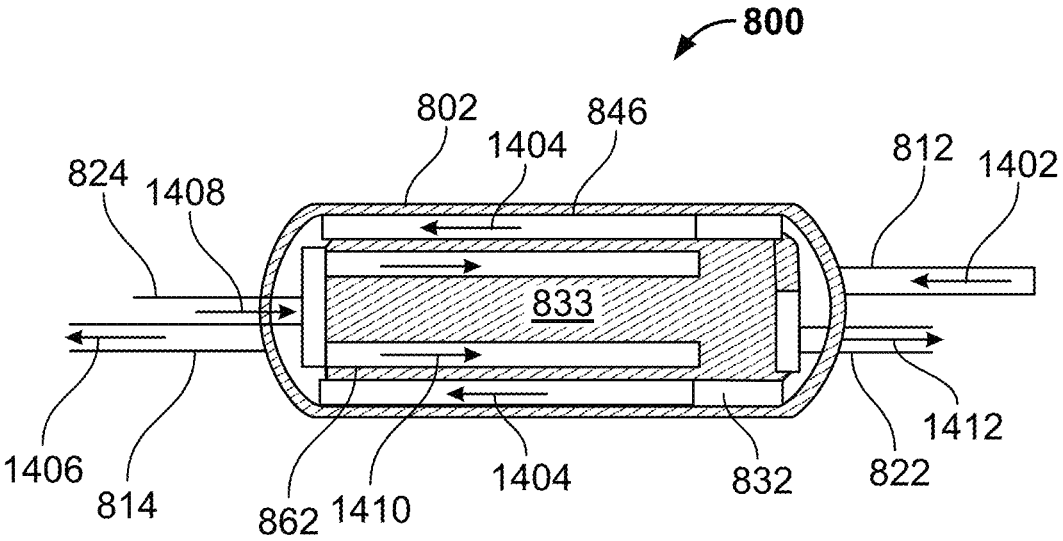
FIG. 14 shows an axial cross sectional view of the heat exchanger of FIG. 8.

FIG. 14 shows an axial cross section of the heat exchanger 800 of FIG. 8. As can be seen in FIG. 14, the direction of cold fluid into heat exchanger 800 via cold fluid inlet 812 is shown by arrow 1402. The direction of flow of cold fluid in cold fluid collection slots 844 is shown by arrows 1404. The direction of flow of cold fluid exiting the heat exchanger 800 via cold fluid outlet 814 is shown by arrow 1406. As can be further seen in FIG. 14, the direction of hot fluid into heat exchanger 800 via hot fluid inlet 824 is shown by arrow 1408. The direction of flow of hot fluid in hot fluid distribution slots 862 is shown by arrows 1410. The direction of flow of hot fluid exiting the heat exchanger 800 via hot fluid outlet 826 is shown by arrow 1412. In such a manner, heat is transferred from the hot fluid to the cold fluid through the inner shell 830.

Figure 15:
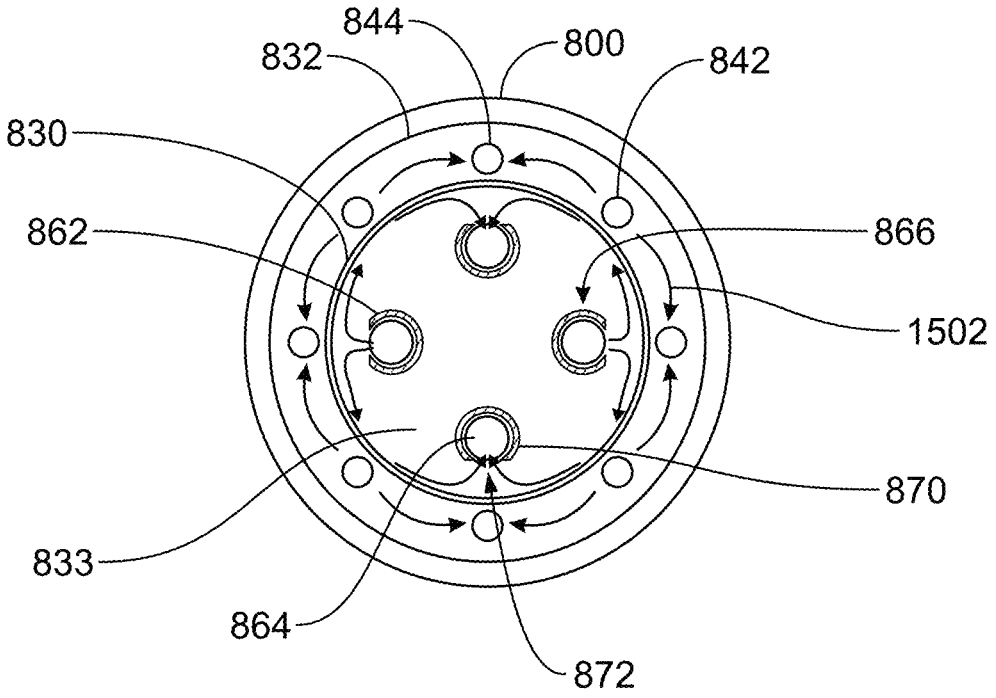
FIG. 15 shows a center diameter radial cross sectional view of the heat exchanger of FIG. 8.

FIG. 15 shows a radial cross section of heat exchanger 800. As can be seen in FIG. 15, cold fluid exits the cold fluid distribution slots 842 and flows radially through the outer heat transfer foam 832 to the cold fluid collections slots 844 where it is collected. The direction of flow shown by arrows

1502. As can further be seen in FIG. 15, hot fluid exits the hot fluid distribution slots 862 and flows radially through the inner heat transfer foam 833 to the hot fluid collection slots 864 where it is collected. The hot fluid distribution and collection slots 862, 864 are lined with sleeves 870 that are impervious to the hot fluid and having openings 872 that direct the fluid in an outward radial direction into the outer heat transfer foam 832. In another embodiment, the slots 862, 864 may be partially sealed to direct fluid in the desired manner. The slots are lined or otherwise sealed to direct flow as shown in FIG. 15.

Figure 16:
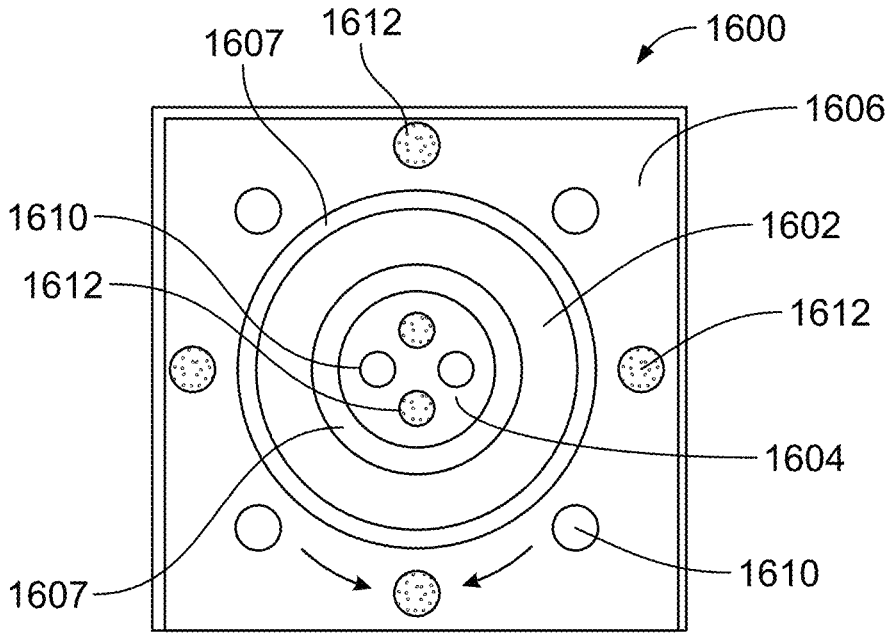
FIG. 16 shows a center diameter radial cross sectional view of a heat exchanger according to another embodiment of the invention.

FIG. 16 shows a cross section of another embodiment of a heat exchanger 1600 according to the present invention. In this embodiment, hot fluid traverses the heat exchanger 1600 through an annular region 1602. Cold fluid traverses the heat exchanger through both an inner cold foam region 1604 and an outer cold foam region 1606. The annular region 1602 is separated from the inner cold foam region 1604 and the outer cold foam region 1606 by impervious sleeves 1607. The inner and outer cold foam regions 1604, 1606 include cold fluid distribution slots 1610 and cold fluid collection slots 1612. In this exemplary embodiment, the axial direction of cold fluid flow across the heat exchanger 1600 is in the same direction. In another embodiment, the axial flow of cold fluid across the heat exchanger 1600 may be in opposite directions In an embodiment, a thick wall may be used for liquid metals which is the case for this figure where the pressure differential between the gas (~4 MPa) and the liquid metal (100 kPa) is large. Then the separation wall must be thick and less efficient. This would also be true if the using two dissimilar gases at very different pressures. Then efficiency may be sacrificed for structural integrity. The cold fluid distribution slots 1610 and cold fluid collection slots 1612 may be sleeved or partially sleeved to direct fluid flow within the inner and/or outer cold foam regions 1604, 1606.

In this disclosure, the term circumferential flow is intended to include substantially circumferential flow, such that the majority of the mass flow direction is in the circumferential direction through the foam and there is little axial flow. There may also be a radial flow embodiment, but it would not be as efficient or as easy to fabricate.

Although the detailed description contains many specifics, these should not be construed as limiting the scope of the invention but merely as illustrating different examples and aspects of the invention. It should be appreciated that the scope of the invention includes other embodiments not discussed in detail above. Various other modifications, changes and variations which will be apparent to those skilled in the art may be made in the arrangement, operation and details of the method and apparatus of the present invention disclosed herein without departing from the spirit and scope of the invention as defined in the appended claims. Therefore, the scope of the invention should be determined by the appended claims and their legal equivalents.

What is claimed is:

1. A heat exchanger, comprising:

a hot fluid transfer passage;

a foam material surrounding the hot fluid transfer passage; and an outer shell surrounding the foam material;

wherein the foam material comprises a plurality of fluid distribution slots extending across the foam material from a first manifold in a first axial direction towards a second manifold and a plurality of fluid collection slots extending from the second manifold towards the first manifold, the fluid distribution slots and fluid collection slots alternating and beings distributed radially around the hot fluid transfer passage; and wherein the fluid distribution and collection slots and the foam material are configured to that a fluid distributed to the fluid distribution slots enters the foam material to flow radially to be collected by the fluid collection slots.

2. The heat exchanger of claim 1, wherein the hot fluid transfer passage is an annular pipe.

3. The heat exchanger of claim 1, wherein the fluid distribution slots are tapered away from the first manifold.

4. The heat exchanger of claim 1, wherein the fluid collection slots are tapered away from the second manifold.

5. The heat exchanger of claim 1, wherein the hot fluid transfer passage has an inner surface comprises a dendritic coating.

* * * * *